United States Patent [19]

Mullet

[11] Patent Number: 4,463,533

[45] Date of Patent: Aug. 7, 1984

[54] SHEET MATERIAL ROOFING PANEL

[76] Inventor: Willis J. Mullet, 1574 Cleveland Rd., Wooster, Ohio 44691

[21] Appl. No.: 391,500

[22] Filed: Jun. 24, 1982

[51] Int. Cl.[3] ..... E04F 15/14; E04D 1/00; E04D 1/34

[52] U.S. Cl. ..... 52/394; 52/478; 52/529; 52/539; 52/542; 52/546

[58] Field of Search ..... 52/478, 543, 545, 546, 52/547, 536, 539, 309.8, 309.9, 512, 520, 595, 802, 480, 588, 394, 395, 403, 529, 479

[56] References Cited

U.S. PATENT DOCUMENTS

| | | | |
|---|---|---|---|
| 1,101,824 | 6/1914 | Whyte | 52/543 |
| 2,038,433 | 1/1936 | Lawrence, Jr. | 52/512 |
| 2,880,481 | 1/1959 | Robinson, Jr. | 52/512 |
| 3,294,036 | 12/1966 | Van Moss, Jr. | 52/478 |
| 3,394,515 | 7/1968 | Widdowson | 52/478 |
| 3,394,524 | 7/1968 | Howarth | 52/588 |
| 3,462,906 | 8/1969 | Schroyer | 52/478 |
| 3,466,831 | 9/1969 | Lenoir | 52/478 |
| 3,481,094 | 12/1969 | Taylor | 52/394 |
| 3,511,011 | 5/1970 | Straus | 52/545 |
| 4,037,377 | 7/1977 | Howell et al. | 52/309.9 |
| 4,075,806 | 2/1978 | Alderman | 52/478 |
| 4,106,250 | 8/1978 | Cummings et al. | 52/394 |
| 4,109,437 | 8/1978 | Player et al. | 52/536 |
| 4,123,885 | 11/1978 | Scott | 52/802 |
| 4,155,206 | 5/1979 | Player | 52/478 |
| 4,184,301 | 1/1980 | Anderson et al. | 52/309.9 |
| 4,196,554 | 4/1980 | Anderson et al. | 52/588 |
| 4,223,503 | 9/1980 | Hague | 52/478 |
| 4,269,012 | 5/1981 | Mattingly et al. | 52/394 |
| 4,295,316 | 10/1981 | Carlson | 52/588 |
| 4,296,581 | 2/1978 | Heckelsberg | 52/520 |
| 4,316,351 | 2/1982 | Ting | 52/309.9 |

FOREIGN PATENT DOCUMENTS

| | | | |
|---|---|---|---|
| 0289816 | 1/1968 | Australia | 52/545 |
| 0716554 | 6/1968 | Netherlands | 52/520 |

*Primary Examiner*—John E. Murtagh
*Assistant Examiner*—Andrew Joseph Rudy
*Attorney, Agent, or Firm*—Renner, Kenner, Greive & Bobak

[57] ABSTRACT

A composite roofing panel having an upper sheet material panel portion (10) with upstanding male and female edge flanges (14 and 15, respectively) adapted to be interlocked by relative lateral movement with the edges of like panels, and having a lower insulation panel portion (20) with male and female edges (18 and 17, respectively) adapted to be interengaged with the male and female edges of like panels by relative lateral movement.

10 Claims, 7 Drawing Figures

SHEET MATERIAL ROOFING PANEL

TECHNICAL FIELD

The invention relates to sheet material roofing panels having upstanding male and female edge flanges adapted to interlock with edge flanges on like panels to form a standing seam roof.

BACKGROUND ART

Various constructions of interlocking sheet metal panels have been proposed for assembling into a roof having upstanding joints or seams between the panels. This type of roof is sometimes called a "standing seam" roof and is frequently laid over insulation and supported upon the roof substructure. The insulation may be in the form of strips or panels supported on the roof purlins.

Many of the prior interlocking panels have had interengaging flanges requiring rolling or other metal-forming operations to seal the joints, or the application of special interlocking strips after the panels have been laid on the roof in order to form weather-tight seals. The use of such expedients in installing a roof is time-consuming and expensive, and the results are often unsatisfactory.

U.S. Pat. No. 4,269,012 shows one form of sheet metal panels having upstanding interlocking male and female edges in which the interlocking is accomplished by positioning one panel with its web flat on the roof substructure, then lifting the next panel so that its web is nearly vertical and its female edge flange is hooked over the male edge flange of the first panel, and then rotating the second panel downwardly until its web lays flat on the roof substructure. The male edge flange of each panel is secured ENC. to a roof purlin by clips hooked into the top of the flange and extending downwardly through insulation strips for securement to the purlin.

U.S. Pat. No. 4,106,250 shows another form of sheet metal panels having interlocking edges in which one panel is positioned flat on the roof and secured directly to a roof purlin, and the female edge flange of the next panel is lifted over the male edge flange of the first panel and forced downwardly into interlocking engagement therewith.

Both of these patented constructions require lifting of all or one side of one panel during the interlocking operation, and because these panels are long, unwieldy and easily distortable, the operation becomes difficult and tedious. Moreover, if insulation is required between the roofing panels and the roof substructure, it may be separately installed before the roof panels are laid, or if the insulation is pre-attached it results in a heavier and more unwieldy panel to be lifted and manipulated during the interlocking operation.

DISCLOSURE OF THE INVENTION

The present invention comprises a composite roof panel having an upper sheet material panel portion with upstanding male and female edge flanges adapted to be interlocked by relative lateral movement with the edges of like panels, and having a lower insulation panel portion integral therewith with male and female edges adapted to be interengaged with the male and female edges of like panels by relative lateral movement.

It is an object of the present invention to provide an improved sheet material roofing panel having upstanding male and female edge flanges adapted to be interlocked with the upstanding male and female edge flanges of like panels by relative lateral movement of the panels and without requiring subsequent forming of the interlocking flanges or the subsequent application of sealing strips.

Another object is to provide an improved composite panel having an upper roofing portion with male and female edge flanges adapted to interlock with male and female edges of like panels, and a lower insulating portion having male and female side edges adapted to interfit with the side edges of like panels, said lower portion adapted to nest in the upper portion of a like panel for shipment.

A further object is to provide an improved composite roofing panel having an upper sheet metal roofing portion and a lower insulation portion, said upper portion having upstanding male and female edge flanges adapted to be interlocked by relative lateral movement with the upstanding male and female edge flanges of like panels.

A still further object is to provide an improved composite roofing panel having an upper sheet metal roofing portion and a lower insulation portion, said upper portion having upstanding male and female edge flanges and said lower portion having male and female side edges, said upper edge flanges and lower side edges adapted to be interlocked by relative lateral movement with the edges of like panels.

These and other objects are accomplished by the parts, improvements and combinations comprising the present invention, a preferred embodiment of which is shown and disclosed herein by way of example as representing the best known mode of carrying out the invention. Various modifications and changes in details of construction are comprehended within the scope of the appended claims.

PREFERRED EMBODIMENT OF THE INVENTION

Figure 1:
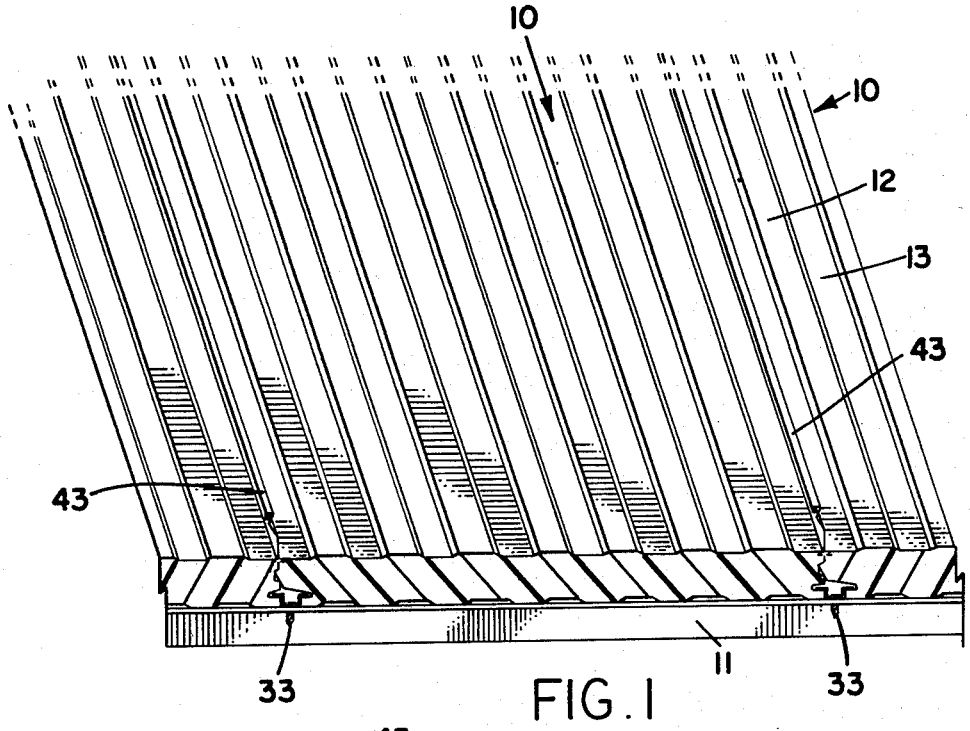
FIG. 1 is a perspective view of a portion of a roof made up of the improved composite roofing panels.

Referring to FIG. 1, showing a portion of a roof made up of panels according to the invention, the improved panels are indicated generally at 10, and are supported on the roof substructure which includes beams or purlins one of which is indicated at 11.

Figure 2:
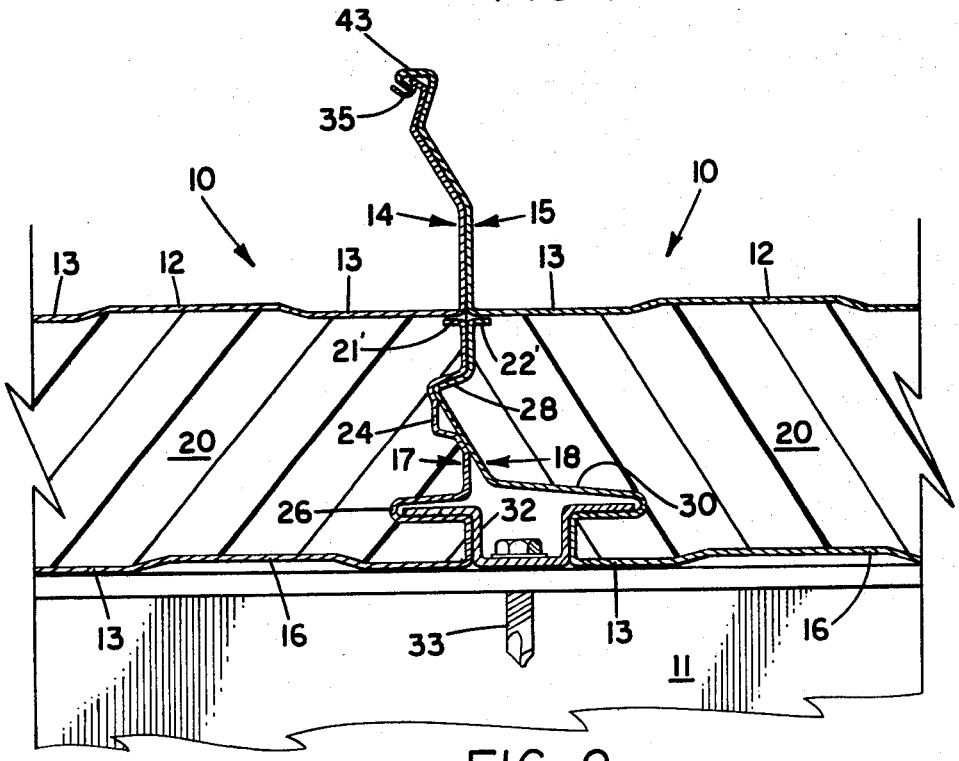
FIG. 2 is an enlarged cross-sectional view showing the male and female edges of two of the improved composite panels in interlocked relation supported on a roof purlin or beam.
Figure 3:
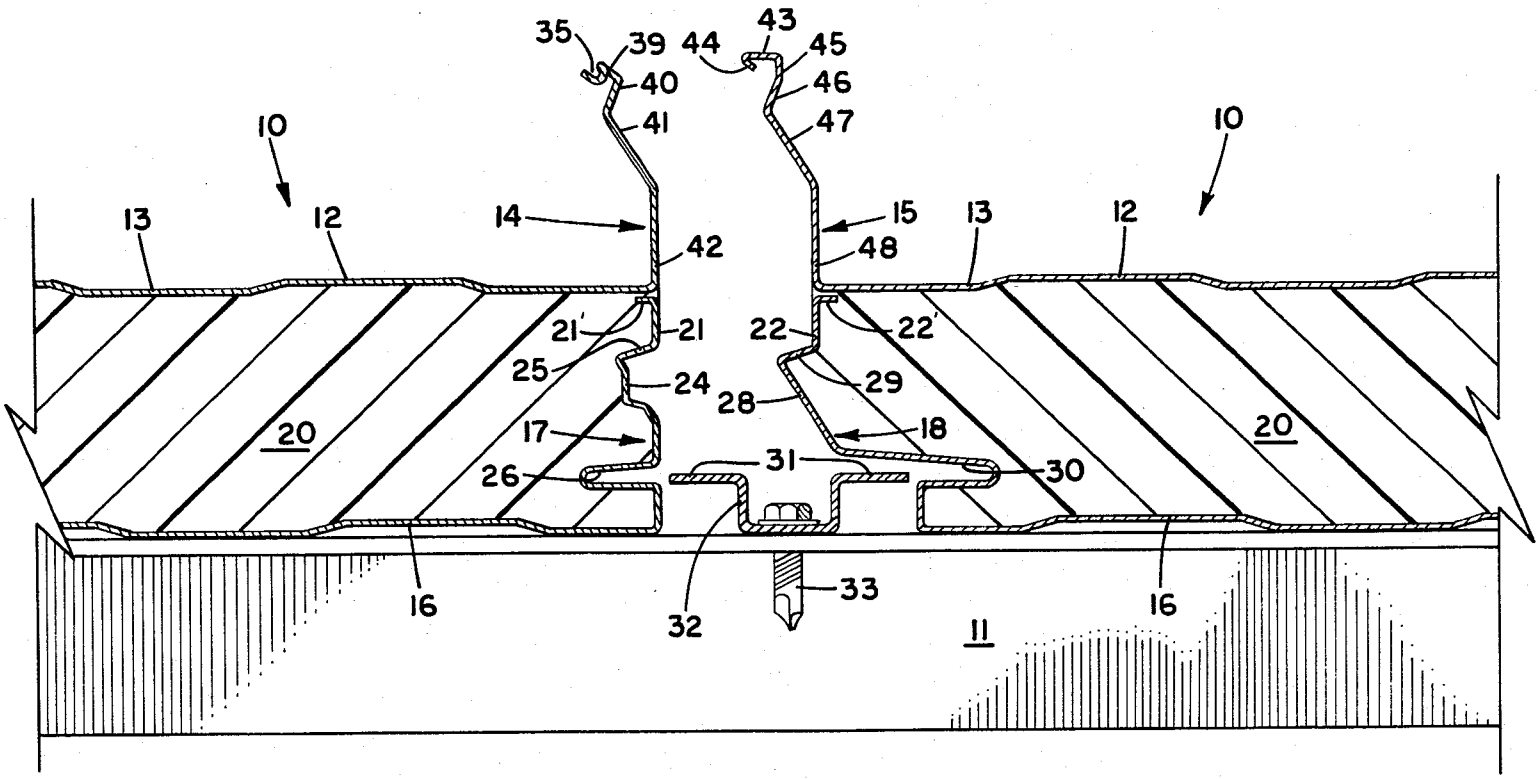
FIG. 3 is a similar view showing the two edges spaced apart in readiness to be moved laterally into interlocking relation.

As shown in FIGS. 2 and 3, each panel 10 comprises an upper skin or web 12, preferably of sheet metal, which may have corrugations 13 formed therein extending longitudinally of the panel. An integral upstanding male flange 14 is formed along one lateral edge of each panel skin 12 and an integral upstanding female flange 15 is formed along the opposite edge. Each panel 10 further comprises a lower skin or web 16 parallel to web 12, preferably of sheet metal, which may also have corrugations 13 formed therein extending longitudinally of the panel. An integral upstanding female flange 17 is formed along one lateral edge of each panel skin and an integral upstanding male flange 18 is formed along the opposite edge. The space between the upper and lower skins is preferably filled with thermal insulating material 20, which may be polyurethane foam, for example, adhered to the interior surfaces of the skins.

As clearly shown, the upper edges of the flanges 17 and 18 have vertical portions 21 and 22 terminating in inturned lips 21' and 22', respectively, which are spaced below the upper skins and the spaces are filled with the thermal insulation material 20, thus providing a thermal break between the upper and lower skins 12 and 16.

The female flange 17 has an inwardly disposed longitudinal channel 24 with a downwardly inclined upper leg 25 below portion 21 and a longitudinal groove 26 is spaced below said channel. The male flange 18 has a longitudinal angular rib 28 with a downwardly inclined upper leg 29 adapted to interfit into channel 24 as shown in FIG. 2. A longitudinal groove 30 is spaced below rib 28 opposite to the groove 26. The grooves 26 and 30 are adapted to receive the longitudinally extending horizontal flanges 31 of a clip 32 secured to the support member 11 by screws 33 when the panels are moved laterally into abutment as shown in FIG. 2.

Figure 7:
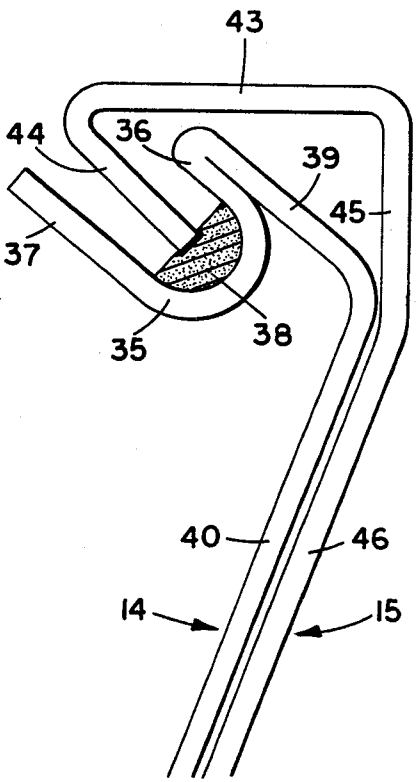
FIGS. 5, 6 and 7 are enlarged partial sectional views of the male and female flanges of two of the upper sheet metal roofing panels in progressive positions as the panels are moved together laterally into interlocking position.
Figure 6:
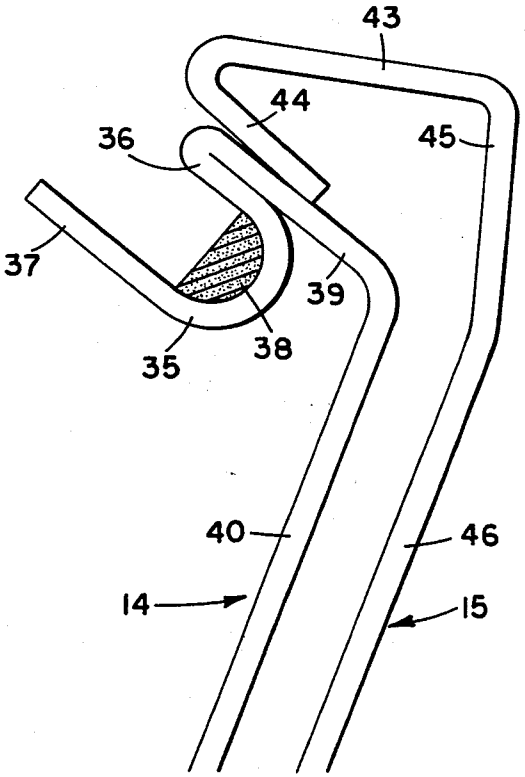
Figure 5:
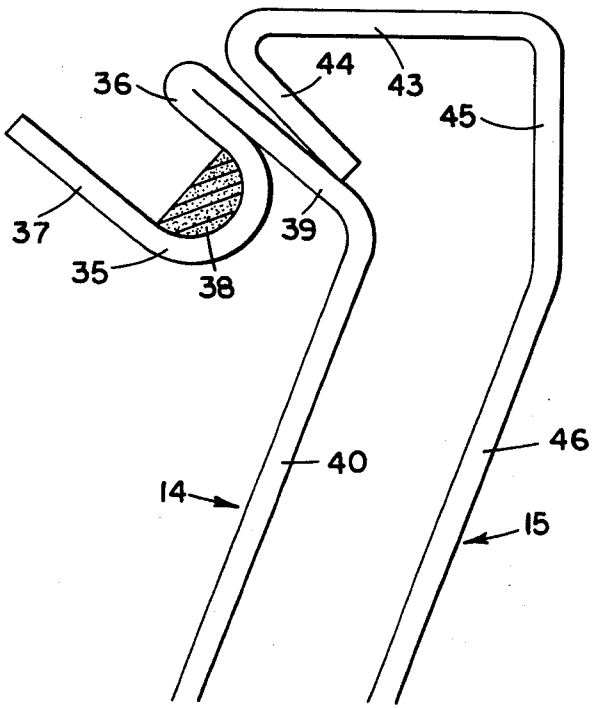

The upper edge of male flange 14 on the upper web 12 has an upwardly open U-shaped channel 35 extending longitudinally of the panel with inner and outer upturned legs 36 and 37, as best seen in FIGS. 5, 6 and 7. A strip of weather-tight sealing material 38 is preferably adhesively secured in the bottom of said channel 35. Said inner leg 36 is preferably doubled back on itself to form an angular leg 39 which merges into a depending leg 40, a reversely inclined leg 41 and then into a vertical portion 42 connected to the edge of web 12.

The upper edge of female flange 15 has a downwardly open channel 43 extending longitudinally of the panel and terminating in a resilient outer downturned leg 44 substantially parallel to leg 39 on the male flange. A vertical leg 45 depends from the inner end of channel 42 and merges into an inclined portion 46, a reversely inclined leg 47 and then into a vertical portion 48 connected to the opposite edge of web 12.

In the operation of installing the improved roofing panels, the clips 32 are first secured to the roof supports 11 at the proper intervals to coincide with the joints between panels. Two panels 10 are then positioned adjacent the clips in the position of FIG. 3, and then moved together laterally so that the clip flanges 31 are received in grooves 26 and 30. As the rib 28 on one lower panel portion 20 enters the channel 24 on the other lower panel portion, the male and female flanges 14 and 15 on the upper webs 12 progressively assume the relative positions shown in FIGS. 5, 6 and 7.

Thus, the leg 44 of channel 43 first engages leg 39 of channel 35 as in FIG. 5, then slides up along leg 39 as in FIG. 6, and snaps over legs 39 and 36 into U-shaped channel 35 as in FIG. 7, wherein the outer edge of leg 44 abuts the sealing strip 38 to form a weather-tight seal, and the legs 40, 41 and 42 of flange 14 are in substantial abutment with legs 46, 47 and 48 of flange 15.

Accordingly, the male and female portions of the two panels are interfitted and interlocked solely by relative lateral movement without requiring lifting, rotating and manipulating one edge into engagement with the other. Moreover, the upper edges of the standing seam or joint between panels are interlocked and sealed without requiring an on-the-site seam rolling or forming operation or the subsequent application of exterior sealing strips.

Figure 4:
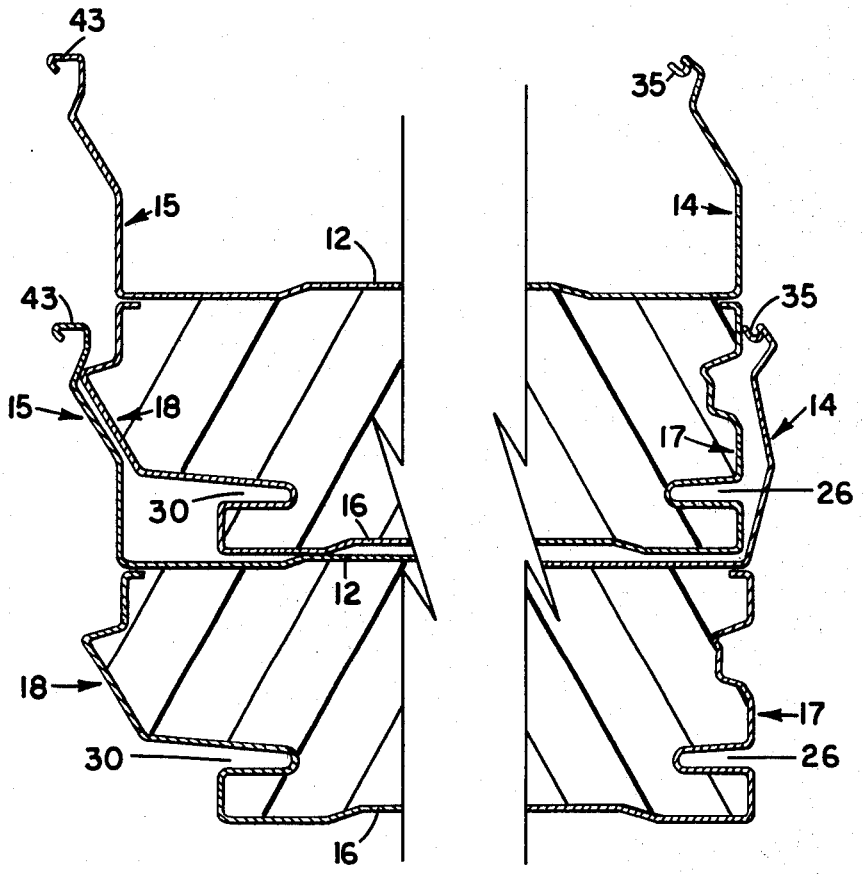
FIG. 4 is a cross-sectional view showing how the panels are nested for shipment.

As shown in FIG. 4, the improved panels may be nested one within another to save space in shipping. In such case, the resiliency of the flange 14 is sufficient to allow springing outward to allow entrance and withdrawal of the flange 17 of another panel.

I claim:

1. A sheet material roofing panel having a web and upstanding male and female edge flanges adapted to be slidably interlocked with the complementary edge flanges of laterally adjacent like panels solely through laterally converging movement relative to the laterally adjacent panels in the plane of the panel supporting surface of the roof, the female edge flange having a downwardly open channel along its upper edge terminating in a resilient downturned inclined leg, and the male edge flange having an upwardly open U-shaped channel along the inside of its upper edge with inner and outer upturned legs, said U-shaped channel being carried by an upwardly inclined angular leg, the length of which extends beyond said downturned inclined leg of said downwardly open channel, said downturned leg of said downwardly open channel being substantially parallel to said inclined angular leg and adapted to snap thereover and interlock within said upwardly open channel on an adjacent panel as said panels are moved laterally together.

2. A sheet material roofing panel as described in claim 1, wherein a resilient sealing strip is located in the U-shaped channel prior to assembly, and the downturned leg of the female flange on the adjoining channel sealingly abuts said strip after assembly.

3. A sheet material roofing panel as described in claim 2, wherein means is provided for securing the interlocked flanges of adjoining panels to the substructure of the supporting roof.

4. A sheet material roofing panel as described in claim 1, wherein means is provided for securing the interlocked flanges of adjoining panels to the substructure of the supporting roof.

5. A composite roof panel comprising an upper sheet material portion having an upper web and upstanding upper male and female edge flanges adapted to be slidably interlocked with the complementary edge flanges of laterally adjacent like panels solely through laterally converging movement relative to the laterally adjacent panels in a plane parallel to said upper web, the upper female edge flange having a downwardly open channel along its upper edge terminating in a resilient downturned inclined leg, the upper male edge flange having an upwardly open U-shaped channel along the inside of its upper edge with inner and outer upturned legs, said U-shaped channel being carried by an upwardly inclined angular leg, the length of which extends beyond said downturned inclined leg of said downwardly open channel, said downturned leg of said downwardly open channel being substantially parallel to said inclined angular leg and adapted to snap thereover and interlock within said upwardly open channel on an adjacent panel as said panels are moved laterally together, a lower insulating panel portion secured under the upper web of the upper portion and having a lower web parallel to said upper web and upstanding lower male and female edge flanges adapted to interfit with the complementary edge flanges of the laterally adjacent like panel portions solely through laterally opposing movement relative to the laterally adjacent panels in a plane parallel to said webs, and a core of insulating material between and adhering to the upper and lower webs.

6. A composite roof panel as described in claim 5, wherein a yieldable sealing strip is located in the bottom of the U-shaped channel prior to assembly, and the outer downturned leg of the downwardly open channel on the female flange on the adjoining panel sealingly abuts said strip after assembly.

7. A composite roof panel as described in claim 6, wherein means engaging the interfitting male and female edge flanges of two adjoining insulating panel portions are adapted for securement to the roof substructure.

8. A composite roof panel as described in claim 5, wherein means engaging the interfitting male and female edge flanges of two adjoining insulating panel portions are adapted for securement to the roof substructure.

9. A composite roof panel as described in claim 5, wherein the male and female edge flanges of the lower insulating panel portion are contoured to allow said panel portion to nest within the male and female edge flanges of the upper sheet metal panel portion of a like composite roof panel for compact shipment.

10. A composite roof panel as described in claim 5, wherein the male and female edge flanges of the lower insulating panel portion are contoured to allow said panel portion to nest within the male and female edge flanges of the upper sheet metal panel portion of a like composite roof panel for compact shipment.

* * * * *